United States Patent [19]

Holmes et al.

[11] Patent Number: 4,882,861

[45] Date of Patent: Nov. 28, 1989

[54] BAGGAGE AND SECURITY LABEL, PRIMARILY FOR USE BY AIRLINES

[75] Inventors: Peter G. Holmes, Tattershall Thorpe; Michael Lowe, Great Hale; Christopher Donaghue, Boston, all of England

[73] Assignee: Norprint International Limited, Boston, England

[21] Appl. No.: 109,213

[22] Filed: Oct. 15, 1987

[30] Foreign Application Priority Data

Oct. 15, 1986 [GB] United Kingdom ..... 24714

[51] Int. Cl.[4] ..... G09F 3/100

[52] U.S. Cl. ..... 40/299; 283/80

[58] Field of Search ..... 40/299, 665; 283/80, 283/81, 79

[56] References Cited

U.S. PATENT DOCUMENTS

| | | | |
|---|---|---|---|
| 3,808,718 | 6/1973 | Christiansen | 40/299 |
| 4,277,902 | 1/1979 | Miniaci et al. | 40/299 |
| 4,666,185 | 5/1987 | Pilborough | 40/299 |

FOREIGN PATENT DOCUMENTS

| | | |
|---|---|---|
| P2442711 | 9/1974 | Fed. Rep. of Germany . |
| 2144239 | 5/1972 | France . |
| 969149 | 1/1963 | United Kingdom . |
| 1068891 | 7/1964 | United Kingdom . |
| 1071871 | 8/1964 | United Kingdom . |
| 1107960 | 6/1966 | United Kingdom . |
| 1169200 | 12/1966 | United Kingdom . |
| 2067161 | 2/1980 | United Kingdom . |

*Primary Examiner*—Gene Mancene
*Assistant Examiner*—Michael Lynch
*Attorney, Agent, or Firm*—Leydig, Voit & Mayer

[57] ABSTRACT

A labelling tag, primarily intended for airline baggage, comprises four members initially adhered together so that each member is adhered to at least one other member, one member being elongated and having an adhesive layer such that when separated from the remaining members it can form a loop, the remaining members each including a layer of adhesive by which that member is detachably adhered to another of said members and by which that member can be adhered to an article, separation of the members not resulting in the creating of any litter.

8 Claims, 3 Drawing Sheets

| FLT. No. | | DATE | |
|---|---|---|---|
| CONT. No. | | HOLD POSN. | |
| 1 | 2 | 3 | 4 |
| 5 | 6 | 7 | 8 |
| 9 | 10 | 11 | 12 |
| 13 | 14 | 15 | 16 |
| 17 | 18 | 19 | 20 |
| 21 | 22 | 23 | 24 |
| 25 | 26 | 27 | 28 |
| 29 | 30 | 31 | 32 |

FIG. 11.

BAGGAGE AND SECURITY LABEL, PRIMARILY FOR USE BY AIRLINES

BACKGROUND OF THE INVENTION

1. Field of the Invention

This invention relates to baggage and security tags or labels for use, for example, in ensuring that aircraft security is enhanced by being able quickly and reliably to relate specific items of baggage actually loaded to the appropriate owner passengers who have been checked-in and manifested to travel on the aircraft, and/or to identify baggage belonging to manifested but non-embarked passengers. The invention is also applicable to other situations where it is important that a specific quantity of items in a given location precisely relate to either persons or articles, generally in a different location.

2. Summary of the Prior Art

Of recent years security has been a matter of prime concern to airline operators and one aspect of this security is to ensure that all accepted and/or loaded items of hold-baggage are precisely related to the appropriate owner passengers actually assembled for embarkation or who are on board an aircraft. If, for example, the number of passengers actually present on board the aircraft prior to take-off is less than the number of passengers manifested, there is a substantial risk that a passenger has checked in one or more items of baggage but has not actually boarded the aircraft. This gives rise to an immediate suspicion that the "passenger" is a terrorist and it is therefore desirable to be able to check prior to take-off whether or not an adverse security situation has arisen. Obviously, any such checking must be carried out extremely rapidly within the constraints of airline timetables and avoidance of irritation to passengers for additional delays. Such checking is substantially simplified with certain aircraft now in service, in which items of baggage are not loaded into the baggage hold on an item by item basis but are aggregated by common destination airport into special containers.

While the need for security is paramount in aircraft operations, the invention is also applicable to other situations where a corroborative check needs to be made to ensure that the specific articles in one location precisely conform to validated expectations.

It has already been proposed in GB-A-2151205 to provide an airline baggage label a pat of which is capable of being formed into a loop and other parts of which have operational functions for the airline using the labels. The individual parts are so adhered together that when separated no litter is created.

It is an object of the present invention to provide an airline baggage label which enables an additional security check of baggage to be carried out quickly while, at the same time, avoid the generation of any litter when the label is broken down to its constituent parts.

It is a further object to provide an airline baggage label of some complexity which can nevertheless be put into use very rapidly at airport check-in stations.

SUMMARY OF THE INVENTION

According to the present invention, there is provided a labelling tag comprising four members initially adhered together to form a whole so that each member is adhered to at least one other such member, one said member being elongate and having a first pressure-sensitive adhesive layer covering a portion only of one face of the member such that when separated from the other members the first member can form a loop on itself by non-adhesive coated portion thereof, becoming adhered to the first adhesive layer, the remaining members each including at least one layer of pressure-sensitive adhesive by which that member is detachably adhered to at least one other of said members and by which that member can be adhered to an article, separation of the members resulting in the creation of no litter.

According to the present invention, there is further provided a labelling tag comprising a first elongate member having a first pressure-sensitive adhesive layer extending substantially from one end to a transverse line approximately at half the length of the member, the first member being intended to form a loop when detached from remaining members of the tag by adhesion of said first layer to a remaining part of the first member, a second layer of pressure-sensitive adhesive on the first member, spaced from the first layer, a piece of paper coated with a release agent only on the face thereof directed away from the said second layer and completely covering said first layer whereby the piece of paper is permanently adhered to the second layer, a third layer of pressure-sensitive adhesive on the first member at an end part thereof remote from said first end of the first member and spaced from the second layer, a piece of paper coated with a release agent only on the face thereof directed away from the third layer whereby the piece of paper is permanently adhered to the third layer and completely covers it, a second elongate member extending substantially from said one end of the first member to a transverse line spaced from the other end of the first member, a fourth layer of pressure-sensitive adhesive on the second member and extending substantially from said one end of the first member to a line spaced from the other end of the second member, an elongate piece of paper provided with a release agent on the face only thereof directed away from the said fourth layer and completely covering and adhered to the fourth layer, a fifth layer of pressure-sensitive adhesive provided on the second member, spaced from the fourth layer and from said other end of the second member, said piece of paper being permanently adhered to the second layer and completely covering but being detachably adhered to the said fifth layer, a third member of the tag forming a separate extension, in the assembled condition of the tag, of the first member, a sixth layer of pressure-sensitive adhesive on the third member spaced from the first member and spaced from the end of the third member remote from the first member, a fourth member having a seventh layer of adhesive detachably adhering the fourth member to the piece of paper permanently adhered to the third adhesive layer of the first member, the seventh layer being spaced from the end of the fourth member adjacent to the second member, an eighth layer of adhesive on the fourth member spaced from the seventh layer, the eighth layer being completely covered by and permanently adhered to a piece of paper coated with a release agent on the face only thereof directed away from the eighth layer and being detachably adhered to the sixth layer of adhesive of the third member, each said piece of paper having a length greater than that one of the layers of adhesive to which it is permanently secured and a length less than that one of the layers of adhesive to which it is detachably secured the assembly of the tag being such that all said members are initially adhered to at least one opposed member and so that the fourth member spans and holds together the otherwise separate first and third members and on separation each of the second, third and fourth members has a respective said adhesive layer by which it can be adhered to an article and the first member can be bent and adhered to itself to form a loop, no litter being created when the members are separated at the initial point of use.

The term "paper" is intended to refer herein both to conventional paper and to plastics based synthetic paper and to laminates of these materials, both paper to paper, plastics to plastics and paper to plastics.

BRIEF DESCRIPTION OF THE DRAWINGS

An airline baggage tag or label embodying the invention, will now be described, by way of example only, with reference to the accompanying diagrammatic drawings in which:-

FIG. 11 is a plan view of a checking sheet used for security purposes in connection with the said fourth member of the tag.

In FIGS. 4 to 6 inclusive, broken lines denote boundaries of various pressure-sensitive adhesive layers and chain lines represent boundaries of paper pieces which are coated with a release agent on one face only.

DESCRIPTION OF THE PREFERRED EMBODIMENT

Figures 1, 2, 3, 4, 5, 6:
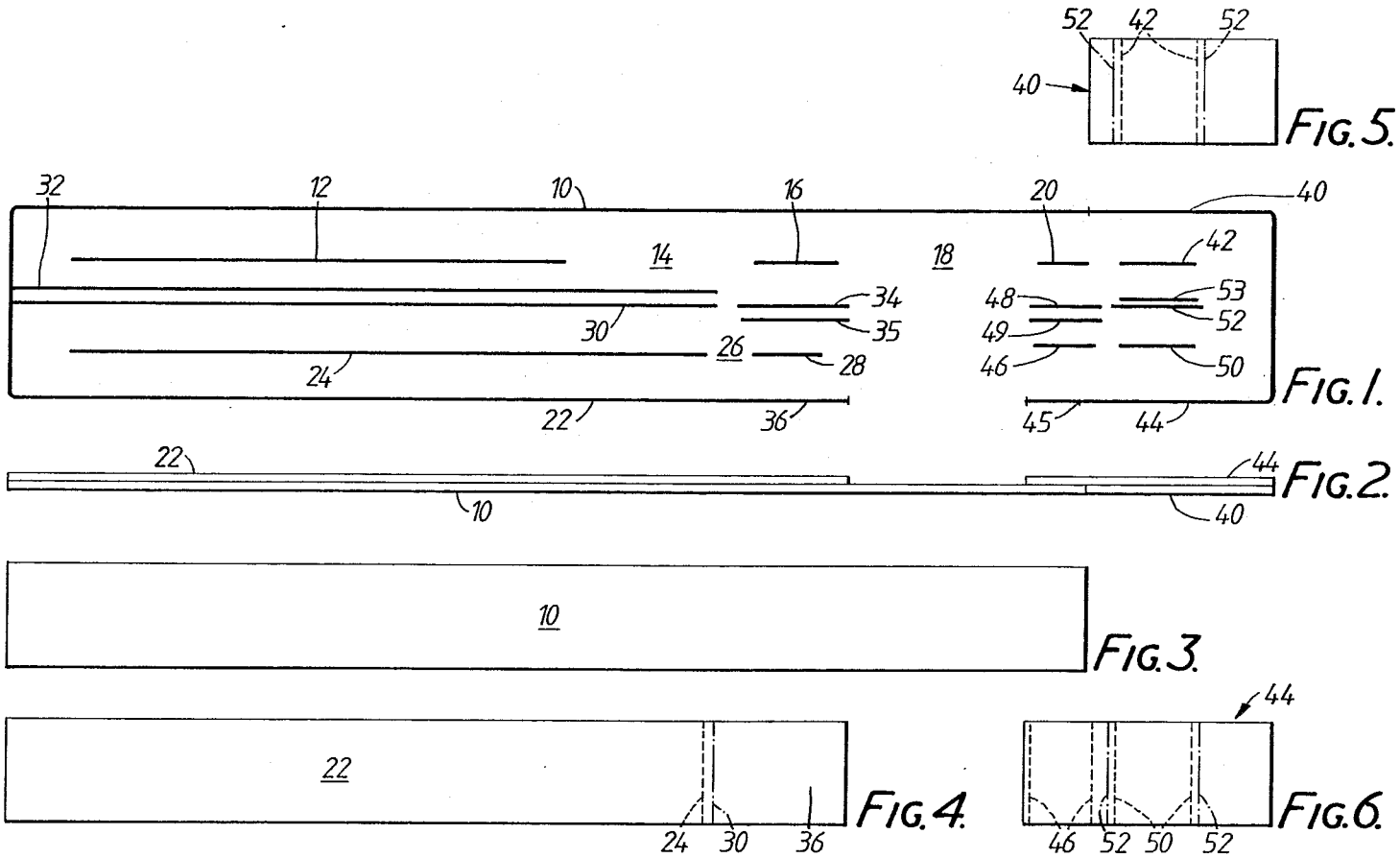
FIG. 1 is a side elevation of the tag or label showing layers thereof exaggerated in thickness and spacing between the layers.
FIG. 2 is a side elevation showing the juxtaposition of the four separable component members of the label or tag in their initially adhered state with the spacing between the members eliminated but the thickness of the members exaggerated.
FIG. 3 is a plan view illustrating separately a first member of the tag or label according to FIG. 1.
FIG. 4 is a plan view of a second member of the tag of FIG. 1.
FIG. 5 is a plan view of a third member of the tag of FIG. 1.
FIG. 6 is a plan view of a fourth member of the tag of FIG. 1.
Figure 9:
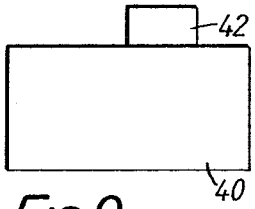
FIG. 9 is an exploded, perspective, diagram further illustrating the laminar composition of the third member.
Figure 10:
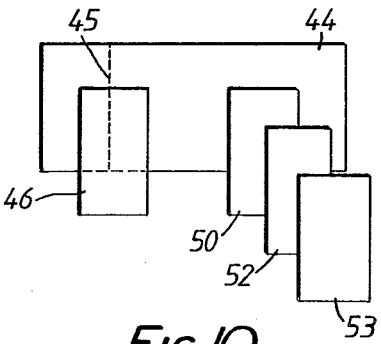
FIG. 10 is an exploded, perspective, diagram further illustrating the laminar composition of the fourth member.
Figure 7:
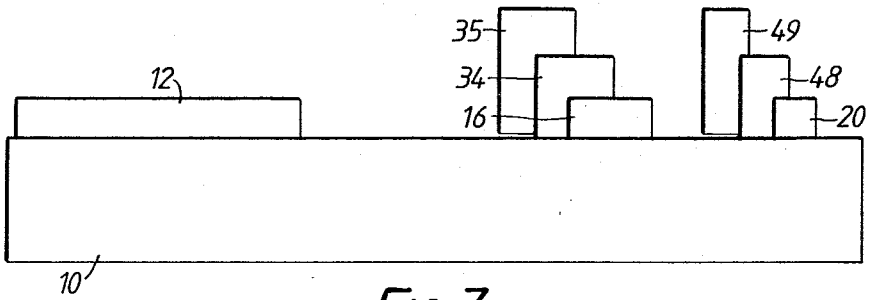
FIG. 7 is an exploded, perspective, diagram further illustrating the laminar composition of the first member.
Figure 8:
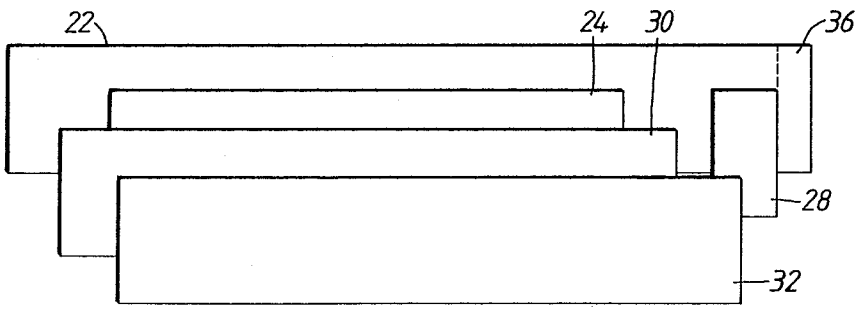
FIG. 8 is an exploded, perspective, diagram further illustrating the laminar composition of the second member.

Referring now to the drawings, the tag or label in accordance with the invention comprises a first member 10 of elongate rectangular form and which has on a part of its reverse face a first, pressure-sensitive adhesive layer 12 extending almost from one end (the left-hand end as shown) of the member for a distance equal to approximately one half of the overall length of this first member. The material of the member is preferably a paper, plastics, paper laminate, and may for example be one marketed under the code number 868. The adhesive used will be very aggressive since in operational use when adhered to the other half of the tag to form a loop it is required to withstand high loads, including shock loads. A typical adhesive suitable for this purpose is manufactured and marketed by National Adhesives and Resins Limited of Slough, Berkshire, England under the trade name TEXGRIP TM. It is a semi-permanent, rubber-based, pressure-sensitive adhesive.

Approximately at the centre and for a distance to the right, as shown, of the centre, a portion 14 of this first member 10 is free of adhesive and, continuing towards the right on the reverse face this is succeeded by a short strip 16 of pressure-sensitive adhesive referred to as the second layer.

Again, proceeding towards the right-hand end of member 10, a further adhesive-free portion 18 is followed by a very short length of pressure-sensitive adhesive layer 20 (third layer) on the reverse face which extends to the extreme right-hand end of member 10.

A second member 22 extends from the extreme left-hand edge of the tag as a whole to a line just to the right-hand boundary of the second adhesive layer 16 and this second member is coated with a pressure-sensitive adhesive layer 24 from a transverse line spaced from its left-hand end (as shown) to a transverse line spaced from its right-hand end. The layer 24 is referred to herein as the fourth layer. Moving towards the right a space 26 is left free of adhesive and a further layer of adhesive 28 (fifth layer) extends from the right-hand end of the blank space 26 to a transverse line spaced from the right-hand end of the second member 22.

The fourth layer 24 of pressure-sensitive adhesive which has been applied to the second member 22 is itself fully covered by a portion 30 which is impregnated with a pressure-sensitive chemical (known per se) which changes color when pressure, such as printing pressure or writing pressure is applied so that indicia are produced. The reverse face of this portion 30 which is directed towards the adhesive fourth layer 24 of the second member 22 is plain i.e. untreated with any release agent, so that the portion permanently adheres to the second member. However, a left-hand end part of this portion is not adhered to the second member for a purpose to be described hereinafter. At the right-hand end the pressure-sensitive chemically impregnated portion 30 extends slightly beyond the layer of adhesive 24. A suitable material for the portion 30 has the designation R26 and is a 67 grams per square metre single side coated, self-copying bleached paper.

That face of the portion 30 which is opposite to that facing the adhesive layer 24 is coated with a silicone 32 so that it does not permanently adhere to the first layer 12 of adhesive.

On the second member 22, to the right, as shown in FIG. 1, a fifth layer of adhesive 28 is fully covered by a portion of silicone impregnated honey glassine paper 34, the face directed towards the layer 28 being coated with a silicone layer 35, the opposite face of the portion being permanently adhered to the second layer of adhesive 16 on the first member 10. The piece of paper 34, as all other similar pieces of paper forming parts of the label assembly, is sold under the designation R13 and is a 67 gram per square metre, single side coated, honey glassine paper.

In the assembled condition of the first and second members 10, 22 a small, right-hand part 36 of the second member is not adhered in any way to the first member so that when it is desired, at the point of use, to separate the two members, the non-adhered portion is easily lifted so that peeling and detachment can readily and rapidly take place.

As already indicated, to the right of the right-hand end of the second member 22, the first member 10 is free of adhesive and silicone at space 18 so that when the two members 10, 22 are separated the left-hand, adhesive coated portion of member 10 can be adhered to its uncoated right-hand portion so that firm, permanent adhesion is achieved. The practice in transportion applications is to loop the first member around the handle of an item of baggage and, if the first member is made of a plastics paper the strength both of the paper and of the adhesive is very high. Nevertheless, breakage of the loop formed by the member 10 is possible and as a further safeguard the extreme right-hand portion of the tag or label is constructed as follows.

A third, separate, member 40 effectively forms a continuation of the first member 10 and lies in the same plane when the members are all assembled together, as shown. This member 40 has on its reverse face a transverse strip of adhesive 42 (sixth layer) which is spaced from both ends and lies opposite a fourth member 44 which overlaps with the first member, this fourth member being adhered, in the assembled condition to the first member 10 by a transverse layer of adhesive 46 (seventh layer) which adheres to a transverse strip of honey glassine 48 which has been treated on one surface only with silicone 49. The strip of glassine 48 is adhered permanently to a right-hand end part of the first member by the layer 20 of pressure-sensitive adhesive. The third and fourth members 40, 44 are adhered together by the layer of adhesive 42 (sixth layer) on the third member 40 which co-operates with but is narrower than a glassine strip 52 permanently adhered to an adhesive strip 50 (eighth layer) on the fourth member 44. The glassine strip 52 on the fourth member 44 is coated with silicone 53 only on the face lying opposite the third member 40. To enhance the ability of baggage handlers wearing gloves to detach efficiently the fourth member 44 from the first member 10, the fourth member is perforated at a transverse line 45 close to the right-hand edge of the first member 10. Both the third and fourth members are preferably made of 80 grams per square metre, white, wood free, machine finished, two-side pigmented paper. It is designated by the numeral "708".

For each layer of adhesive which is covered by a portion or piece of paper coated on one face only with silicone, the non-coated face is greater in length than the adhesive layer to which it is permanently adhered. The silicone face is in contrast slightly shorter in length than the corresponding adhesive layer to which it is detachably adhered.

Overall, it will be apparent that the fourth member 44 spans the first and third members 10 and 40 which are not otherwise connected. At the point of use removal of the member 44 results in instant separation of the members 10 and 40 without the need to sever perforations.

In the preferred embodiment illustrated a single tag is shown but for many purposes the labels will be made as a band which can be printed at a check-in station of an airport on a high speed dot matrix printer. To enable feed through the printer where there is no adhesion between members end parts are provided with traction holes (not shown) which pass through the first and second members 10, 22 at the left-hand end, and the third and fourth members 40, 44 at the right-hand end. If this modification is adopted, airlines are saved the expense of holding large stocks of preprinted baggage labels since the flight number, destination and other indicia can readily be printed at the check-in station. Alternatively, some information may be pre-printed such as the name of the airline and information as to the rights of the passenger in the event of baggage loss.

At the point of use, the baggage tag will be separated very quickly during check-in formalities into its constituent members 10, 22, 40, 44 and without any generation of litter, the first member 10 being looped around a baggage handle, the second member 22 (known as the baggage claim check portion) being adhered to the passenger's ticket, the third member 40 will be adhered onto the bag concerned as an additional safeguard in the event that the loop 10 is broken, and the fourth member 44 is adhered to a container contents check list card as illustrated in FIG. 11. Alternatively, the third member 40 is adhered to the passenger's boarding pass card, so that those articles of hold-baggage checked-in may be rapidly verified against known embarked passengers.

When the aircraft concerned is ready for departure, that is, with the hold baggage loaded and the passengers boarded, it is necessary only to examine the contents check list card (FIG. 11) relating to the loaded baggage containers to ensure that baggage loaded relates only to passengers boarded. This improves the chance of detecting any explosive device which may have been planted as hold-baggage since terrorists are not normally prepared to sacrifice their own lives by being on board the aircraft when the explosive device detonates. When the items of baggage are stowed into containers prior to the loading of the latter into the aircraft hold, the check card attached to each container clearly indicates the precise quantity of items actually stowed inside that container. Any discrepancy may then result in the passengers being called to disembark until a thorough safety check has been made.

What is claimed is:

1. A labelling tag comprising four members initially detachably adhered together to form a whole assembly such that each member is adhered to at least one other such member, a first said member being elongate and having a first pressure-sensitive adhesive layer covering a portion only of one face of the member such that when separated from the other members the first member can form a loop by a non-adhesive coated portion thereof becoming adhered to the first adhesive layer.

a second said member partially covering and being detachably adhesively secured to the first said member by said first adhesive layer, a third said member separate from the first member but initially lying in the same plane as and forming effectively a continuation of the first member, and a fourth said member completely covering and being detachably adhesively secured to the third member and partly covering and being detachably adhesively secured to an end portion of the first member so that the fourth member effectively spans the first and third member and thus maintains the tag integral until the point of use.

2. A labelling tag according to claim 1, wherein the first member has a second layer of pressure-sensitive adhesive spaced from the first layer and a third layer of pressure-sensitive adhesive spaced from the second layer and covering an end portion of the first member, each of said second and third layers being fully covered by respective pieces of paper each of which is coated with a release agent on the face thereof directed away from the first member, the other faces being permanently adhered to the respective second and third layers of adhesive.

3. A labelling tag according to claim 2, wherein the second member has a fourth layer of adhesive extending over a substantial proportion of its length and a fifth layer of adhesive spaced from the fourth layer, the tag further comprising an elongate piece of paper having a chemical impregnated therein, which on application of pressure produces a visible mark, and which is also coated with a release agent on the face thereof directed away from the second member, said elongate piece of chemically impregnated paper completely covering, in the assembled condition, the first layer of the first member, the fifth layer of adhesive adhering to the piece of release agent coated paper of the second layer on the first member, the elongate piece of paper covering the fourth layer of adhesive being permanently adhered thereto.

4. A labelling tag according to claim 3, wherein the third member has a sixth said layer of adhesive spaced from each end thereof and the fourth member has a seventh and an eighth said layer of adhesive, each layer being spaced from the ends of the fourth member, the eighth layer being fully covered by a piece of paper coated with release agent on the face thereof directed away from the fourth member so that the fourth member is detachably adhered to the sixth layer of adhesive on the third member, the seventh layer of adhesive being adhered to the piece of paper on the first member which covers the third layer of adhesive.

5. A labelling tag according to claim 4 wherein each said piece of paper has a greater length than that one of said layers of adhesive to which it is permanently adhered and is shorter than that one of said layers of adhesive to which it is detachably secured.

6. A labelling tag according to claim 1, wherein the second and fourth members are spaced by a gap.

7. A labelling tag according to claim 1, wherein the labelling tags are initially made as a band adapted for printing by a high speed dot matrix printer at the point of use and for separation from adjacent labelling tags after printing.

8. A labelling tag comprising a first elongate member having a first pressure-sensitive adhesive layer extending substantially from one end to a transverse line approximately at half the length of the member, the first member being intended to form a loop when detached from remaining members of the tag by adhesion of said first layer to a remaining part of the first member, a second layer of pressure-sensitive adhesive on the first member, spaced from the first layer, a piece of paper coated with a release agent only on the face thereof directed away from the said second layer and completely covering said first layer whereby the piece of paper is permanently adhered to the second layer, a third layer of pressure-sensitive adhesive on the first member at an end part thereof remote from said first end of the first member and spaced from the second layer, a piece of paper coated with a release agent only on the face thereof directed away from the third layer whereby the piece of paper is permanently adhered to the third layer and completely covers it, a second elongate member extending substantially from said one end of the first member to a transverse line spaced from the other end of the first member, a fourth layer of pressure-sensitive adhesive on the second member and extending substantially from said one end of the first member to a line spaced from the other end of the second member, an elongate piece of paper provided with a release agent on the face only thereof directed away from the said fourth layer and completely covering and adhered to the fourth layer, a fifth layer of pressure-sensitive adhesive provided on the second member, spaced from the fourth layer and from said other end of the second member, said piece of paper being permanently adhered to the second layer and completely covering but being detachably adhered to the said fifth layer, a third member of the tag forming a separate extension, in the assembled condition of the tag, of the first member, a sixth layer of pressure-sensitive adhesive on the third member spaced from the first member and spaced from the end of the third member remote from the first member, a fourth member having a seventh layer of adhesive detachably adhering the fourth member to the piece of paper permanently adhered to the third adhesive layer of the first member, the seventh layer being spaced from the end of the fourth member adjacent to the second member an eighth layer of adhesive on the fourth member spaced from the seventh layer, the eighth layer being completely covered by and permanently adhered to a piece of paper coated with a release agent on the face only thereof directed away from the eighth layer and being detachably adhered to the sixth layer of adhesive of the third member, each said piece of paper having a length greater than that one of the layers of adhesive to which it is permanently secured and a length less than that one of the layers of adhesive to which it is detachably secured, the assembly of the tag being such that all said members are initially adhered to at least one opposed member and so that the fourth member spans and holds together the otherwise separate first and third members and on separation each of the second, third and fourth members has a respective said adhesive layer by which it can be adhered to an article and the first member can be bent and adhered to itself to form a loop, no litter being created when the members are separated at the initial point of use.

* * * * *